US005489235A

United States Patent [19]

Gagliardi et al.

[11] Patent Number: 5,489,235

[45] Date of Patent: Feb. 6, 1996

[54] ABRASIVE ARTICLE AND METHOD OF MAKING SAME

[75] Inventors: John J. Gagliardi, Hudson, Wis.; Roger C. Lokken, Woodbury, Minn.

[73] Assignee: Minnesota Mining and Manufacturing Company, St. Paul, Minn.

[21] Appl. No.: 120,297

[22] Filed: Sep. 13, 1993

[51] Int. Cl.[6] ..... B24D 11/00

[52] U.S. Cl. ..... 451/527; 451/530; 451/534; 451/539; 51/295

[58] Field of Search ..... 51/293, 295, 298, 51/395, 396, 397, 398, 399; 451/527, 530, 534, 539

[56] References Cited

U.S. PATENT DOCUMENTS

| | | | |
|---|---|---|---|
| 2,115,897 | 5/1938 | Wooddell et al. | 51/188 |
| 2,242,877 | 5/1941 | Albertson | 51/293 |
| 2,755,607 | 7/1956 | Haywood | 51/185 |
| 3,048,482 | 8/1962 | Hurst | 51/298 |
| 3,605,349 | 9/1971 | Anthon | 51/402 |
| 4,644,703 | 2/1987 | Kaczmarek et al. | 51/401 |
| 4,773,920 | 9/1988 | Chasman et al. | 51/295 |
| 4,930,266 | 6/1990 | Calhoun et al. | 51/293 |
| 5,014,468 | 5/1991 | Ravipati et al. | 51/295 |
| 5,015,266 | 5/1991 | Yamamoto | 51/393 |
| 5,107,626 | 4/1992 | Mucci | 51/293 |
| 5,152,917 | 10/1992 | Pieper et al. | 51/295 |
| 5,219,462 | 6/1993 | Bruxvoort et al. | 51/293 |

FOREIGN PATENT DOCUMENTS

| | | | |
|---|---|---|---|
| 2-83172 | 3/1990 | Japan | B24D 11/00 |
| 4-159084 | 6/1992 | Japan | B24D 1/00 |
| 2094824 | 9/1982 | United Kingdom | B24D 11/04 |

*Primary Examiner*—Deborah Jones

*Attorney, Agent, or Firm*—Gary L. Griswold; Walter N. Kirn; Richard Francis

[57] ABSTRACT

The invention provides an abrasive article having a surface having a machine direction axis and opposite side edges, each side edge being parallel to the machine direction axis and a plurality of parallel rows of abrasive composites in fixed position on the surface, each row being aligned at an angle with a side edge which is neither 0° nor 90°, and methods for making such an abrasive article. The abrasive article of this invention also can be used in any convenient form including an endless belt. The resulting abrasive article provides a high rate of cut, long belt life, and a relatively fine surface finish on the workpiece being abraded.

15 Claims, 2 Drawing Sheets

ABRASIVE ARTICLE AND METHOD OF MAKING SAME

BACKGROUND OF THE INVENTION

1. Field of the Invention

This invention relates to an abrasive article (e.g., sheet or belt) having a plurality of ridges of abrasive material deployed on a surface thereof so as not to be aligned with its machine direction and to methods for making the same.

2. Background Art

In general abrasive articles comprise a plurality of abrasive particles bonded either together (e.g., a bonded abrasive or grinding wheel) or to a backing (e.g., a coated abrasive). These abrasive articles have been utilized to abrade and finish workpieces for well over a hundred years.

One problem that has always plagued the abrasive industry is the generally inverse relationship associated between the cut rate (i.e., the amount of workpiece removed for a given time interval) and the useful life of the abrasive article. What is desired by the industry is an abrasive article that has a relatively high rate of cut, a long usable life, and which imparts a relatively fine, and smooth, surface finish on the workpiece being abraded.

One solution to this problem is disclosed in U.S. Pat. No. 5,152,917 (Pieper et al.). Pieper al. teaches a structured abrasive that results in a relatively high rate of cut with long abrasive life. U.S. application 08/067,708 filed May 26, 1993 (Mucci et al.) teaches a method of imparting a fine finish on a workpiece by using a structured abrasive and oscillating either the workpiece or abrasive during use, such that the resulting scratch pattern crosses the previous scratch pattern, resulting in a finer finish.

There exists a vast array of different abrading applications. While Pieper et al. and Mucci et al. represent advancements in the abrasive field for many abrading applications, there remains room for improvement even above and beyond Pieper et al. and Mucci et al.

Other Related Art

U.S. Pat. No. 2,115,897 (Wooddell et al.) teaches an abrasive article having a backing having attached thereto by an adhesive a plurality of bonded abrasive segments. These bonded abrasive segments can be adhesively secured to the backing in a specified pattern.

U.S. Pat. No. 2,242,877 (Albertson) teaches a method of making a compressed abrasive disc. Several layers of coated abrasive fibre discs are placed in a mold and then subjected to heat and pressure to form the compressed center disc. The mold has a specified pattern, which then transfers to the compressed center disc, thus rendering a pattern coated abrasive article.

U.S. Pat. No. 2,755,607 (Haywood) teaches a coated abrasive in which there are lands and grooves of abrasive portions. An adhesive coat is applied to the front surface of a backing and this adhesive coat is then combed to create peaks and valleys. Next abrasive grains are projected into the adhesive followed by solidification of the adhesive coat.

U.S. Pat. No. 3,048,482 (Hurst) discloses an abrasive article comprising a backing, a bond system and abrasive granules that are secured to the backing by the bond system. The abrasive granules are a composite of abrasive grains and a binder which is separate from the bond system. The abrasive granules are three dimension and are preferably pyramidal in shape. To make this abrasive article, the abrasive granules are first made via a molding process. Next, a backing is placed in a mold, followed by the bond system and the abrasive granules. The mold has patternized cavities therein which result in the abrasive granules having a specified pattern on the backing.

U.S. Pat. No. 3,605,349 (Anthon) pertains to a lapping type abrasive article. Binder and abrasive grain are mixed together and then sprayed onto the backing through a grid. The presence of the grid results in a patterned abrasive coating.

Great Britain Patent Application No. 2,094,824 (Moore) pertains to a patterned lapping film. The abrasive/binder resin slurry is prepared and the slurry is applied through a mask to form discrete islands. Next, the binder resin is cured. The mask may be a silk screen, stencil, wire or a mesh.

U.S. Pat. Nos. 4,644,703 (Kaczmarek et al.) and 4,773,920 (Chasman et al.) concern a lapping abrasive article comprising a backing and an abrasive coating adhered to the backing. The abrasive coating comprises a suspension of lapping size abrasive grains and a binder cured by free radical polymerization. The abrasive coating can be shaped into a pattern by a rotogravure roll.

U.S. Pat. No. 4,930,266 (Calhoun et al.) teaches a patterned abrasive sheeting in which the abrasive granules are strongly bonded and lie substantially in a plane at a predetermined lateral spacing. In this invention the abrasive granules are applied via a impingement technique so that each granule is essentially individually applied to the abrasive backing. This results in an abrasive sheeting having a precisely controlled spacing of the abrasive granules.

U.S. Pat. No. 5,014,468 (Ravipati et al.) pertains to a lapping film intended for ophthalmic applications. The lapping film comprises a patterned surface coating of abrasive grains dispersed in a radiation cured adhesive binder. To make the patterned surface an abrasive/curable binder slurry is shaped on the surface of a rotogravure roll, the shaped slurry removed from the roll surface and thensubjected to radiation energy for curing.

U.S. Pat. No. 5,015,266 (Yamamoto) pertains to an abrasive sheet by uniformly coating an abrasive/adhesive slurry over an embossed sheet to provide an abrasive coating which on curing has high and low abrasive portions formed by the surface tension of the slurry, corresponding to the irregularities of the base sheet.

U.S. Pat. No. 5,107,626 (Mucci) teaches a method of providing a patterned surface on a substrate by abrading with a coated abrasive containing a plurality of precisely shaped abrasive composites. The abrasive composites are in a non-random array and each composite comprises a plurality of abrasive grains dispersed in a binder.

Japanese Patent Application No. S63-235942 (published Mar. 23, 1990) teaches a method of a making a lapping film having a specified pattern. An abrasive/binder slurry is coated into indentations in a tool. A backing is then applied over the tool and the binder in the abrasive slurry is cured. Next, the resulting coated abrasive is removed from the tool. The binder can be cured by radiation energy or thermal energy.

Japanese Patent Application No. JP 4-159084 published Jun. 2, 1992 teaches a method of making a lapping tape. An abrasive slurry comprising abrasive grains and an electron beam curable resin is applied to the surface of an intaglio roll or indentation plate. Then, the abrasive slurry is exposed to an electron beam which cures the binder and the resulting lapping tape is removed from the roll.

U.S. Ser. No. 07/820,155 filed Jan. 13, 1992 (Calhoun) and assigned to 3M teaches a method of making an abrasive article. An abrasive slurry is coated into recesses of an embossed substrate. The resulting construction is laminated to a backing and the binder in the abrasive slurry is cured. The embossed substrate is removed and the abrasive slurry adheres to the backing.

U.S. Pat. No. 5,219,462 (Bruxvoort et al.) and assigned to 3M teaches a method for making an abrasive article. An abrasive/binder/expanding agent slurry is coated substantially only into the recesses of an embossed backing. After coating, the binder is cured and the expanding agent is activated. This causes the slurry to expand above the surface of the embossed backing.

U.S. Ser. No. 08/004,929 filed Jan. 14, 1993 (Spurgeon et al.) and assigned to 3M teaches a method of making an abrasive article. In one aspect of this patent application, an abrasive/binder slurry is coated into recesses of an embossed substrate. Radiation energy is transmitted through the embossed substrate and into the abrasive slurry to cure the binder.

U.S. Ser. No. 08/120,300 filed Sep. 13, 1993 (Hoopman) and assigned to 3M teaches an abrasive article where the features are precisely shaped but vary among themselves.

SUMMARY OF THE INVENTION

This invention provides an abrasive article, e.g., sheet or belt, having a plurality of ridges of abrasive material deployed on a surface thereof so as not to be aligned with the direction of use of the article (machine direction) or the transverse direction. The abrasive article has a high cut rate and a long use life and is capable of providing a relatively fine surface finish on the workpiece being finished.

In one embodiment, this invention relates to an abrasive article having a surface having a machine direction axis and opposite side edges, each side edge being parallel to the machine direction axis and each a plurality of parallel rows of precisely shaped abrasive composites in fixed position on the surface, each precisely shaped abrasive composite comprising abrasive particles and binder and having a base attached to the surface, a height and a distal end spaced by the height from the surface, the bases of the precisely shaped abrasive composites in the same row being aligned at an angle which is neither 0° nor 90°.

In another embodiment of the invention, the precisely shaped abrasive composites are a continuous line of upraised abrasive material. In an alternate embodiment of the invention, the abrasive ridges each comprise a plurality of separate abrasive composites that are aligned in a line on the surface. In a preferred embodiment, the abrasive ridges are comprised of a plurality of individual composites that are intermittently spaced along the aforesaid line, wherein each of the abrasive composites is precisely shaped and comprises a plurality of abrasive particles dispersed in a binder, which binder provides a means of attachment of the abrasive composites to the aforesaid surface.

In an even further embodiment of the invention, the present invention relates to an endless abrasive belt comprising a surface having a machine direction axis and opposite side edges, wherein the surface is endless along said machine direction axis, and a plurality of parallel rows of precisely shaped abrasive composites in fixed position on the surface, each precisely shaped abrasive composite comprising abrasive particles and binder and having a base attached to the surface, a height and a distal end spaced by the height from the surface, the bases of the precisely shaped abrasive composites in the same row being aligned at an angle with respect to one of the side edges which is neither 0° nor 90°.

The ridges, for this embodiment, likewise each can be constituted by a continuous line of upraised abrasive material, or each ridge may be constituted by a plurality of individual abrasive composites intermittently spaced along a line and attached to at least one major surface of the backing sheet.

In yet another embodiment, the present invention relates to a method for making an abrasive article comprising: applying to a surface having a machine direction axis, opposite ends and opposite side edges, each side edge being parallel to the machine direction axis, a plurality of parallel rows of precisely shaped abrasive composites in fixed position on the surface, each precisely shaped abrasive composite comprising abrasive particles and binder and having a base attached to the surface, a height and a distal end spaced by the height from the surface, the bases of the precisely shaped abrasive composites in the same row being aligned at an angle with respect to one of the side edges which is neither 0° nor 90°.

This method may include the further step of joining together the opposite ends (which can be complementary) of the backing sheet to form a belt-like closed loop with joined ends forming a juncture line so as to align ridges adjacent each end at said juncture line; and securing the joined free ends at the juncture line to form an endless abrasive belt.

In a preferred embodiment of making an endless abrasive belt article of the invention, a method comprises:

(a) providing a backing sheet having a surface, two complementary opposite ends, and opposite side edges;

(b) providing, on the backing sheet, a plurality of parallel elongate ridges in fixed position on the surface, each ridge comprising at least one abrasive composite and having a base extending in the same direction as the side edges, and a distal end which is spaced from the surface;

(c) joining together said two opposite ends of said backing sheet at a juncture line to provide a closed loop having abutted ends positioned in a laterally displaced relationship so that ridges adjacent each of the ends spaced the same distance from their respective side edges are not aligned with one another but so as to align other adjacent ridges at abutted ends; and (d) securing the joined free ends at said juncture line an endless abrasive belt.

The above method may include the further step of slitting the side edges of the closed loop to provide a belt having new side edges which define a substantially uniform belt width therebetween whereby to provide an abrasive belt with a machine direction axis which is aligned in the same direction as the new side edges and abrasive ridges on said backing which are aligned neither normal to nor parallel with the new side edges.

The abrasive article of the present invention produces a long abrasive life which results in a high total cut and can be expected to provide a higher cut rate (rate of stock removal). Other features, advantages and constructs of the invention will be better understood from the following description of figures and the preferred embodiments of the present invention.

DESCRIPTION OF THE PREFERRED EMBODIMENTS

Figure 1:
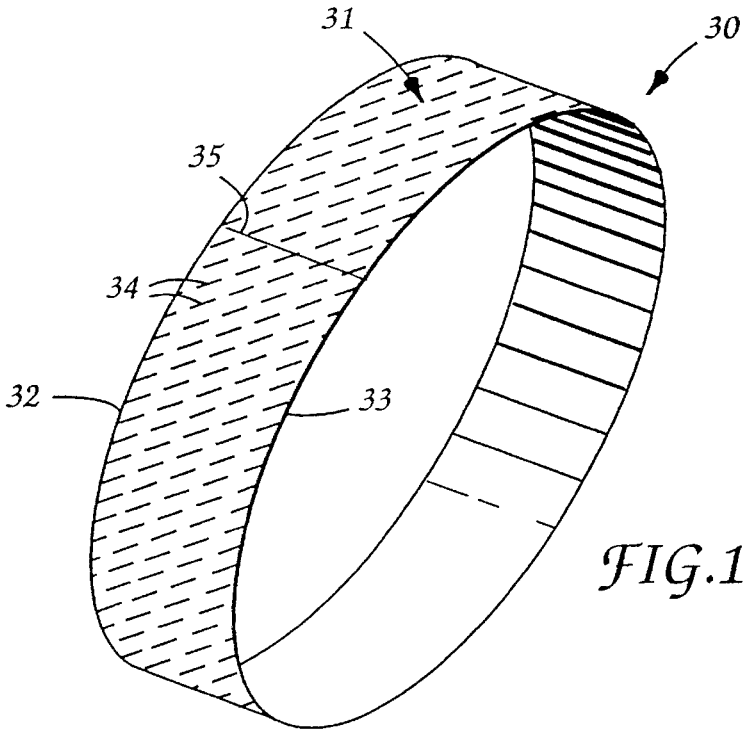
FIG. 1 is a perspective view of an abrasive article of the present invention in the form of an endless belt.

FIG. 1 shows an endless abrasive belt 30 according to the present invention having backing 31, side edges 32 and 33, and two ends spliced at a juncture line 35 extending transversely to the side edges 32 and 33. Attached to backing 31 is an array of abrasive composite ridge segments aligned in rows 34. As can be seen, the abrasive composites ridge segments 34 form a helical or cork-screw pattern on the surface of the coated abrasive article. This nonparallel and nonperpendicular directionality of the ridges in the abrasive article of the present invention, when the coated abrasive article is used in an abrading operation, creates a scratch pattern that crosses the previous scratch pattern. This continuous crossing results in the scratch pattern being continuously refined and generally leads to a finer workpiece surface finish. This crossing also leads to a more random, less uniform scratch pattern which leads to a finer surface finish.

Figure 2:
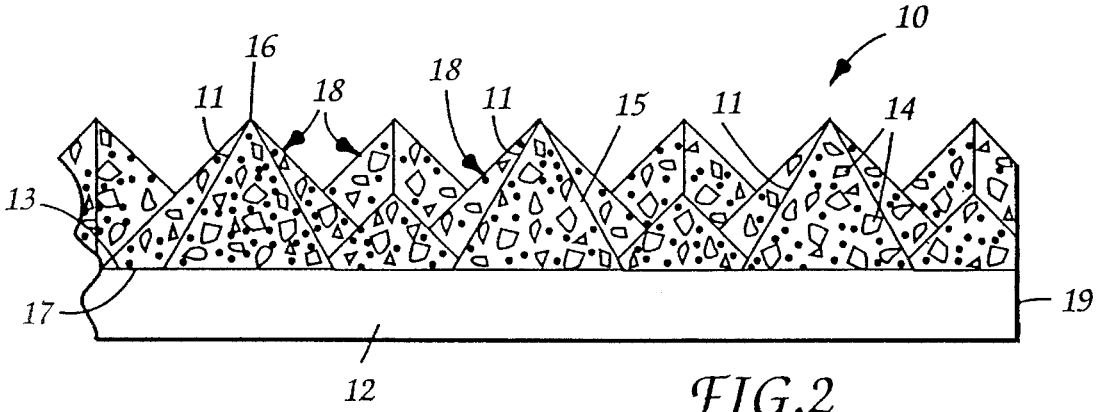
FIG. 2 is an enlarged end view of an abrasive article according to the present invention.
Figure 3:
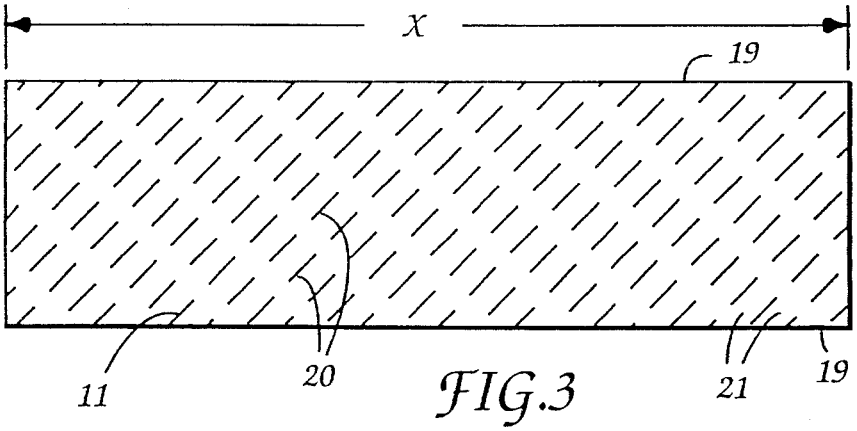
FIG. 3 is a top plane view of a segment of the abrasive article depicted in FIG. 1.

Referring to FIGS. 2–3, an abrasive article 10 has a backing sheet 12 which includes a surface 13 having deployed in fixed position thereon a plurality of abrasive composites in the form of ridge segments 11, for example, bonded to surface 13 thereof. Each abrasive composite 18 comprises a plurality of abrasive particles 14 dispersed in a binder 15. Opposite side edges 19 of backing 12 are parallel to a machine direction axis (not shown in FIG. 2 because it would project toward the viewer) of the surface 13. Ridge segments 11 are aligned in separated rows 20 as depicted in FIG. 3. Ridge segments in the same row are aligned so as to have bases that are aligned so that each row intersects opposite side edge 19 at an angle which is neither 0° nor 90°. For instance, as shown in FIG. 3, ridges 11 are aligned in rows 20, with intervening spaces 21 therebetween, extending to the edge at an angle which is neither 0° nor 90°. Exemplary angles of rows abrasive composites are aligned with respect to the side edge may vary between 1° and 14° as shown in the Examples or may be as much as 45° as shown in FIG. 3 of the drawing. Adjacent ridges can be substantially equally spaced apart, or have different spacings.

While not desiring to be bound to any theory at this time, it is believed that the abrasive article of the present invention is capable of providing grinding action at a slight angle from the machine direction to the overall scratch pattern in order to improve grinding efficiency (cut per path or cut rate). More particularly, this invention is thought to provide an abrasive article having a grinding surface pattern which produces a so-called "cork-screw" action at the grinding interface. By "cork-screw" action, it is meant that as the abrasive article passes through the grinding interface the contacting abrasive composite ridges will continuously appear to have a motion perpendicular to the machine direction of the abrasive article. In essence, then, the material on the surface of the workpiece would be removed at a slight angle to the machine direction scratch pattern of the workpiece.

Backing

While it is possible for the abrasive article of the invention to be formed from a single integral material that is molded to form both the surface and abrasive composite ridges deployed thereon, it is more preferred to provide a backing upon which the abrasive composites are separately attached. In this preferred embodiment, the backing of this invention has a front and back surface and can be any conventional sheet-like material typically used as a backing for a coated abrasive product. Examples of such include polymeric film, cloth, paper, vulcanized fiber sheets, nonwoven fabric sheets, and combinations thereof. Polymeric films may also be treated to improve adhesion, e.g., by priming or other conventional means. The backings may also be treated to seal and/or otherwise modify some physical properties of the backing. These treatments are well known in the art.

The backing may also have an attachment means on its back surface to secure the resulting coated abrasive to a support pad or back-up pad. This attachment means can be a coating of pressure sensitive adhesive material or one mating part of a hook and loop attachment material. Alternatively, the attachment means may be an intermeshing attachment system as described in the U.S. Pat. No. 5,201,101 (Rouser et al.), the disclosure of which is incorporated herein by reference.

The back side of the abrasive article may also contain a coating of a material which improves a slip resistant or frictional engagement with driving devices. An example of such a coating would include a composition comprised of inorganic particulate (e.g., calcium carbonate or quartz) dispersed in an adhesive.

Abrasive Composite

Abrasive Particles

The abrasive particles typically have a particle size ranging from about 0.1 to 1500 micrometers, usually between about 0.1 to 400 micrometers, preferably between 0.1 to 100 micrometers and most preferably between 0.1 to 50 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, fused alumina: zirconia, diamond, iron oxide, ceria, cubic boron nitride, boron carbide, garnet, and combinations thereof.

The term abrasive particles encompasses single abrasive particles and abrasive particles bonded together to form an abrasive agglomerate. Abrasive agglomerates are further described in U.S. Pat. Nos. 4,311,489 (Kressner), 4,652,275 (Bloecher et al.) and 4,799,939 (Bloecher et al.), the disclosures of these patents being incorporated herein by reference.

It is also within the scope of this invention to have a surface coating on the abrasive particles to provide any of a variety of different functions. Surface coatings may be employed to increase adhesion to the binder, alter the abrading characteristics of the abrasive particle and for other purposes. Examples of surface coatings include coupling agents, halide salts, metal oxides including silica, refractory metal nitrides, refractory metal carbides and the like.

In the abrasive composite there may also be diluent particles, e.g., to reduce cost and/or improve performance. The particle size of these diluent particles may be on the same order of magnitude as the abrasive particles. Examples of such diluent particles include gypsum, marble, limestone, flint, silica, glass bubbles, glass beads, aluminum silicate, and the like.

Binder

The abrasive particles are dispersed in an organic binder to form the abrasive composite. The organic binder can be a thermoplastic binder, however, it is preferably a thermosetting binder. The binder is generally formed from a binder precursor. During the manufacture of the abrasive article, a thermosetting binder precursor is exposed to an energy source which aids in the initiation of the polymerization or curing process. Examples of energy sources include thermal energy and radiation energy which includes electron beam, ultraviolet light, and visible light. After this polymerization process, the binder precursor is converted into a solidified binder. Alternatively, for a thermoplastic binder precursor, during the manufacture of the abrasive article the thermoplastic binder precursor is cooled to a degree that results in solidification of the binder precursor. Upon solidification of the binder precursor, the abrasive composite is formed.

The binder in the abrasive composite is generally also responsible for adhering the abrasive composite to the front surface of the backing. However, it some instances there may be an additional adhesive layer between the front surface of the backing and the abrasive composite.

There are two main classes of thermosetting resins, condensation curable and addition polymerized resins. The preferred binder precursors are addition polymerized resin because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binders precursors include phenolic resins, urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, and mixtures and combinations thereof. The term acrylate encompasses acrylates and methacrylates.

Phenolic resins are widely used in abrasive article binders because of their thermal properties, availability, cost and ease of handling. There are two types of phenolic resins, resole and novolac. Resole phenolic resins have a molar ratio of formaldehyde to phenol of greater than or equal to one to one, typically between 1.5:1.0 to 3.0:1.0. Novolac resins have a molar ratio of formaldehyde to phenol of less than one to one. Examples of commercially available phenolic resins include those known by the tradenames "Durez" and "Varcum" from Occidental Chemicals Corp.; "Resinox" from Monsanto; "Aerofene" from Ashland Chemical Co. and "Arotap" from Ashland Chemical Co.

Acrylated urethanes are diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyla dkipamide. Still other nitrogen containing compounds include tris(2-acryloyloxyethyl)-isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant alpha, beta-unsaturated carbonyl group per molecule or oligomer. These unsaturated carbonyl groups can be acrylate, methacrylate, or acrylamide type groups. Examples of such materials include N-hydroxymethyl-acrylamide, N,N'-oxydimethylenebisacrylamide, ortho and para acrylamidomethylated phenol, acrylamidomethylated phenolic novolac, and combinations thereof. These materials are further described in U.S. Pat. No. 4,903,440 (Larson et al.) and U.S. Pat. No. 5,236,472 (Kirk et al.) both incorporated herein by reference.

Isocyanurate derivatives having at least one pendant acrylate group and isocyanate derivatives having at least one pendant acrylate group are further described in U.S. Pat. No. 4,652,274 (Boettcher et al.) incorporated herein after by reference. The preferred isocyanurate material is a triacrylate of tris(hydroxyethyl) isocyanurate. Epoxy resins have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)-phenyl propane] (diglycidyl ether of bisphenol) and commercially available materials under the trade designation "Epon 828", "Epon 1004", and "Epon 1001F" available from Shell Chemical Co., "DER-331", "DER- 332", and "DER-334" available from Dow Chemical Co. Other suitable epoxy resins include glycidyl ethers of phenol formaldehyde novolac (e.g., "DEN-431" and "DEN-428" available from Dow Chemical Co.).

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other cationic curing agents include a salt having an organometallic complex cation and a halogen containing complex anion of a metal or metalloid which are further described in U.S. Pat. No. 4,751,138 (Tumey et al.) incorporated here in after by reference. Another example is an organometallic salt and an onium salt is described in U.S. Pat. No. 4,985,340 (Palazzotto) (column 4 line 65 to column 14 line 50); European Patent Applications 306,161 and 306,162, all incorporated here in after by reference. Still other cationic curing agents include an ionic salt of an organometallic complex in which the metal is selected from the elements of Periodic Group IVB, VB, VIB, VIIB and VIIIB which is described in European Patent Applications 109,851 incorporated herein by reference.

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632 (Oxman et al.), entitled Coated Abrasive Binder Containing Ternary Photoinitiator System incorporated herein by reference. The preferred initiator for use with visible light is "Irgacure 369" commercially available from Ciba Geigy Corporation.

Additives

The abrasive slurry can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphtalene, pentachloronaphthalene, and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metals include, tin, lead, bismuth, cobalt, antimony, cadmium, iron and titanium. Other miscellaneous grinding aids include sulfur, organic sulfur compounds, graphite and metallic sulfides.

Examples of antistatic agents include graphite, carbon black, vanadium oxide, humectants, and the like. These antistatic agents are disclosed in U.S. Pat. Nos. 5,061,294 (Harmer et al.); 5,137,542 (Buchanan et al.), and 5,203,884 (Buchanan et al.) incorporated herein by reference.

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 square meters/gram that is commercially available from DeGussa Corp., under the trade name "OX-50".

Abrasive Ridge/Composite Shape

The abrasive composite ridges can be formed by continuous lines of abrasive material or intermittent abrasive composite ridge segments aligned in rows. In the former case, the ridges are formed by appropriately shaping an uncured abrasive slurry with a production tool, described later herein, which is configured to present the converse shape of the desired pattern of ridges. The mold or production tool is removed after the slurry is sufficently cured or gelled to hold the basic contour imparted into the abrasive slurry by the tool cavities.

In the alternate embodiment involving ridges formed of intermittent abrasive composites, each abrasive composite has its own shape associated with it. The shape has a surface or boundaries associated with it that results in one abrasive composite being separated to some degree from another adjacent abrasive composite. To form an individual abrasive composite, a portion of the planes or boundaries forming the shape of the abrasive composite must be separated from one another. This portion is generally the upper portion. The lower or bottom portion of abrasive composites may abut one another. Referring to FIG. 2, adjacent abrasive composite ridge segments 11 may be separated near their distal ends 16 and abutted at their attachment ends 17. It is also possible that adjacent abrasive composites may be completely separated near both the distal end 16 and the attachment end 17 such that the backing is exposed. Although not required, the individual abrasive composite ridge segments usually are equidistantly spaced apart along a common ridge for convenience sake.

The spacing between these abrasive composite ridge segments in a common ridge, from apex to apex, is not particularly limited; although, naturally, the larger the spacing between composites in a row, the smaller the number of composites available for refinishing a workpiece. An acceptable spacing may be empirically determined for any particular shape of composites by observing the abrasion performance provided thereby. Also, for either the continuous ridge composite or segmented composite embodiments of the invention, the pitch distance between different pairs of ridges, as measured from one apex or mid-point of one ridge to that of the adjacent ridge, can be constant or varied. However, for conveniece sake in designing the abrasive article, the pitch distance can be set as a constant value, although this not essential. For purposes of this invention, an adjacent ridge means that which faces a subject ridge over a common groove without any intervening ridges located therebetween.

In any event, if distinct abrasive composite segments are used to constitute the abrasive ridges, the abrasive composite shape can be any shape, regular or irregular, but it is preferably a regular geometric shape such as cubic, prismatic, conical, pyramidal, truncated pyramidal and the like. The resulting abrasive article can have a mixture of different abrasive composite shapes. The preferred shape is pyramidal with 4 to 20 side surfaces (including the base side). Grooves or open spaces left between the ridges of abrasive material also will extend linearly at an angle tracking the angle of extension of the adjoining ridges. Also, the height of the composites is preferred to be constant across the entire area of the abrasive article, but it is possible to have composites of varying heights.

It is preferred that this shape for the abrasive composite be precise or predetermined. This precise shape is illustrated in FIG. 2. The abrasive article 10 comprises a backing 12 and bonded to backing surface 13 are a plurality of abrasive composite ridge segments 11. Inside the abrasive composites are a plurality of abrasive particles 14 dispersed in a binder 15. In this particular illustration, the abrasive composite has a pyramidal type shape. The planar boundaries 18 which define the pyramid are very sharp and distinct. These well defined, planes define the boundary of the precise shape. The abrasive composite shape can also be relatively inexact, irregular or imperfect. The imperfect shape can be caused by the abrasive slurry flowing and distorting the initial shape prior to curing or solidification of the binder precursor. These non-straight, non-clear, non-reproducible, inexact or imperfect planes or shape boundaries is what it is meant by an irregular shape.

It is preferred that each individual abrasive composite has a cross sectional surface area that decreases away from the backing or decreases along its height to its distal end. The height is the distance from the attachment end, i.e., where the abrasive composite is bonded to the backing, to the top or distal end of the abrasive composite, i.e., the further most distance from the backing. During manufacture of the abrasive article, this variable surface area results in easier release of the abrasive composite from the production tool.

The number of abrasive composites can be anywhere from a single composite to over 15,000 composites per square centimeter, but most preferably from about 300 to 10,000 composites per square centimeter. The number of abrasive composites can be correlated to the rate of cut, abrasive life, and also surface finish of the workpiece being abraded.

Method for Making the Abrasive Ridges

In one embodiment, the first step to make the abrasive article is to prepare the abrasive slurry having a composition described hereinabove. The abrasive slurry is made by combining together by any suitable mixing technique the binder precursor, the abrasive particles and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum during the mixing step. In some instances it is preferred to heat, generally in the range of 30° to 70° C., the abrasive slurry to lower the viscosity. It is important that the abrasive slurry have a rheology that coats well and in which the abrasive particles and other fillers do not settle.

Two different techniques can be used to make a pattern of abrasive composites in an abrasive article of this invention and the choice therebetween depends largely on whether precise (regular) or nonprecise (irregular) abrasive composite shapes are desired. The first technique generally results in an abrasive composite that has a precise shape. To obtain the precise shape, the binder precursor is solidified or cured while the abrasive slurry is present in cavities of a production tool. This technique is disclosed in U.S. Pat. No. 5,152,197 (Pieper et al.), which is incorporated by reference. The second technique generally results in an abrasive composite that has an irregular shape. In the second technique, which is a variant from the general technique disclosed in U.S. Pat. No. 5,152,197, the abrasive slurry is coated into cavities of a production tool to generate the abrasive composites. However, unlike the preferred protocol in U.S. Pat. No. 5,152,197, the abrasive slurry is removed from the production tool before the binder precursor is cured or solidified. Subsequent to this, the binder precursor is cured or solidified. Since the binder precursor is not cured while in the cavities of the production tool this results in the abrasive slurry flowing and distorting the abrasive composite shape.

For both techniques, if a thermosetting binder precursor is employed, the energy source can be thermal energy or radiation energy depending upon the binder precursor chemistry. For both techniques, if a thermoplastic binder precursor is employed, the thermoplastic is cooled such that it becomes solidified and the abrasive composite is formed.

Production Tool

The production tool contains a plurality of cavities, which are essentially the inverse shape of the abrasive composite and are responsible for generating the shape of the abrasive composites. There should preferably be at least one (1) cavity per square centimeter, more preferably at least 10 and most preferably at least 1000 cavities per square centimeter. It is preferred to have between 1,000 and 10,000 cavities per square centimeter. This number of cavities results in making it possible to form an abrasive article therewith having that number of abrasive composites/square centimeter. These cavities can have any of a variety of geometric shapes such as cubic, prismatic, pyramidal, truncated pyramidal, conical, and the like to form individual abrasive composites, or alternatively, the cavities can be linear continuous groove-shapes to form continuous ridges. The dimensions of the cavities are selected to achieve the desired number of abrasive composites/square centimeter. The cavities can be present in a dot-like pattern with spaces between adjacent cavities or the cavities can abut against one another. It is preferred that the cavities abut one another.

The production tool can be a belt, a sheet, a continuous sheet or web, a coating roll such as a rotogravure roll, a sleeve mounted on a coating roll, or die. The production tool can be composed of metal (e.g., nickel), metal alloy, ceramic, or plastic. A metal production tool can be fabricated by any conventional technique such as engraving, hobbing, electroforming, diamond turning, etc. A thermoplastic tool can be replicated off a metal master tool. The master tool will have the inverse pattern desired for the production tool. The master tool is preferably made out of metal, e.g., nickel. The thermoplastic sheet material can be heated and optionally along with the master tool such that the thermoplastic material is embossed with the master tool pattern by pressing the two together. The thermoplastic can also be extruded or east onto to the master tool and then pressed, afterwhich, the thermoplastic material is cooled to solidify and produce a production tool.

The production tool may also contain a release coating to permit easier release of the abrasive article from the production tool. Examples of such release coatings include silicones and fluorochemicals. If a plastic production tool is used, it is preferred that the polymer used is grafted with the silicone or fluorochemical. Further discussion of production tools and masters is set forth in U.S. Ser. No. 08/004,929 (Spurgeon et al. ) filed Jan. 14, 1993.

Energy Sources

When the abrasive slurry comprises a thermosetting binder precursor, the binder precursor is subsequently cured or polymerized. This polymerization is generally initiated upon exposure to an energy source. Examples of energy sources include thermal energy and radiation energy. The amount of energy depends upon several factors such as the binder precursor chemistry, the dimensions of the abrasive slurry, the amount and type of abrasive particles and the amount and type of the optional additives. For thermal energy, the temperature can range from about 30° to 150° C., generally between 40° to 120° C. The time can range from about 5 minutes to over 24 hours. The radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. It is preferred that 300 to 600 Watt/inch (120 to 240 watt/era) ultraviolet lights are used. Visible radiation refers to non-particulate radiation having a wavelength within the range of about 400 to about 800 nanometers, preferably in the range of about 400 to about 550 nanometers, and is preferably used at an energy level of 300 to 600 watt/inch (120 to 240 watt/cm).

Figure 4:
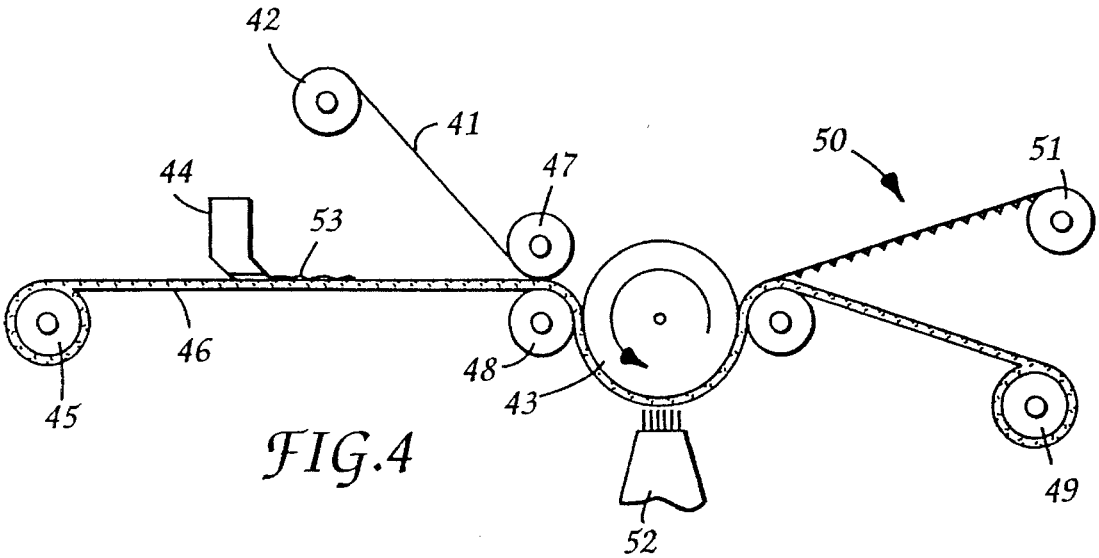
FIG. 4 is a side schematic view depicting a method of making an abrasive article according to the present invention.

One preferred method for making rows of separate abrasive composites on a backing for an abrasive article of the present invention is illustrated in FIG. 4. Backing 41 leaves an unwind station 42 and at the same time the production tool (pattern tool) 46 which is transparent to radiation leaves an unwind station 45. Production tool 46 is coated with abrasive slurry 53 by means of coating station 44. It is possible to heat the abrasive slurry and/or subject the slurry to ultrasonics prior to coating to lower the viscosity. The coating station can be any conventional coating means such as drop die coater, knife coater, curtain coater, vacuum die coater or a die coater. During coating the formation of air bubbles should be minimized. The preferred coating technique is a vacuum fluid bearing die. After the production tool is coated, the backing and the abrasive slurry are brought into contact by any means such that the abrasive slurry wets the front surface of the backing. In FIG. 4, the abrasive slurry is brought into contact with the backing by means of contact nip roll 47. Next, another nip roll 48 also forces the resulting construction against support drum 43. Next, some form of energy is transmitted into the abrasive slurry through the production tool 46 by an energy source 52 to at least partially cure the binder precursor. The term partial cure is meant that the binder precursor is polymerized to such a state that the abrasive slurry does not flow from an inverted test tube. The binder precursor can be fully cured once it is removed from the production tool by any energy source. Following this, the production tool is rewound on mandrel 49 so that the production tool can be reused. Additionally, abrasive article 50 is wound on mandrel 51. If the binder precursor is not fully cured, the binder precursor can then be fully cured by either time and/or exposure to an energy source. Additional steps to make the abrasive article according to this method is further described in U.S. Pat. No. 5,152,917 and U.S. Ser. No. 08/004,929 (Spurgeon et al.) filed Jan. 14, 1993, both incorporated herein by reference.

In a variation of the above method depicted in FIG. 4, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above.

Relative to this above method depicted in FIG. 4, it is preferred that the binder precursor is cured by radiation energy. The radiation energy can be transmitted through the backing or through the production tool. The backing or production tool should not appreciably absorb the radiation energy. Additionally, the radiation energy source should not appreciably degrade the backing or production tool. For instance ultraviolet light can be transmitted through a polyester backing. Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. The more deformable material results in easier processing. For thermoplastic based production tools, the operating conditions for making the abrasive article should be set such that excessive heat is not generated. If excessive heat is generated, this may distort or melt the thermoplastic tooling.

Figure 5:
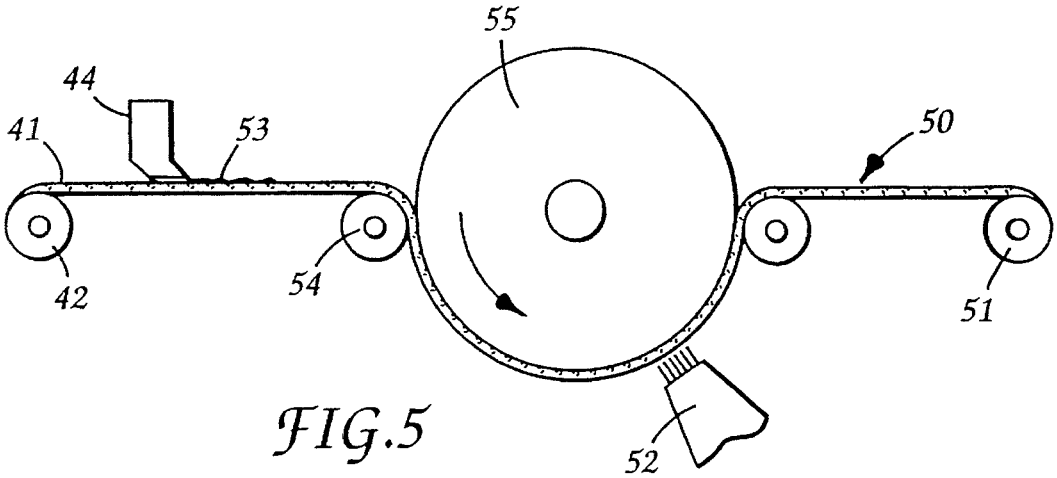
FIG. 5 is a side schematic view depicting an alternative method of making an abrasive article according to the present invention.

Another method for making rows of separate abrasive composites on a backing for an abrasive article of the present invention is illustrated in FIG. 5. Backing 41 leaves an unwind station 42 and the abrasive slurry 53 is coated onto the front surface of the backing by means of the coating station 44. The abrasive slurry can be coated onto the backing by any technique such as drop die coater, roll coated, knife coater, curtain coater, vacuum die coater, or a die coater. Again, it is possible to heat the abrasive slurry and/or subject the slurry to ultrasonics prior to coating to lower the viscosity. During coating the formation of air bubbles should be minimized. Next, the backing and the abrasive slurry are brought into contact with production tool 55 by a nip roll 54 such that the abrasive slurry penetrates into the cavities of the production tool. The abrasive slurry coated backing is exposed to an energy source 52 to initiate the polymerization of the binder precursor and thus forming the abrasive composites. After curing, the backing having the abrasive composites thereon is removed from the production tool, and the resulting abrasive article 50 is wound onto a roll at station 51.

In a variation of the method depicted in FIG. 5, the abrasive slurry can be coated into the cavities of the production tool and not onto the backing. The backing is then brought into contact with the production tool such that the abrasive slurry wets and adheres to the backing. The remaining steps to make the abrasive article are the same as detailed above.

After the abrasive article is cured to its final state, the coated abrasive article is converted into a form which is usable in an abrading operation, such as a sheet, belt, tape, or the like.

Forming, the Abrasive Article of the Present Invention

The present invention involves an abrasive article having a backing with two parallel side edges and ridges comprising continuous lines of abrasive material or rows of intermittent shaped abrasive material bonded thereon. The abrasive composites are arranged in a nonrandom array. Either way, the ridges are arranged on the backing sheet such that the directionality of the ridges runs in a direction that is nonzero ,(nonparallel) and nonperpendicular to the machine direction axis of the abrasive article. The nonzero nonperpendicular angle made by the ridge(s) with the machine direction axis is not particularly limited to any angles or range thereof between zero and 90° as long as these constraints are met. However, as a general observation of the relationship between cutting performance and the angle of the ridges vis-a-vis the side edges of the article backing, and not as a limitation, it can be said that the cutting rate can increase with increasing ridge angle (greater inclination relative to the machine direction axis).

The final abrasive article can be in the form of a sheet, tape, or, most preferred, an endless belt. For example, when an endless belt of the present invention is produced, the ridges, e.g. rows of abrasive composites, form a helical, or cork-screw pattern around the length of the abrasive belt. It will be inherent that with this construction, not all of the ridges will be continuous around the length of the belt, but some of the edges of the array (or several lines) will terminate at the side edges of the backing sheet. Some of the ridges may be continuous. The number of ridges terminating at the backing side edges will be dependent on the angle of the ridges relative to the backing side edges.

In a first method of orienting the abrasive ridges of the abrasive article of the present invention at a nonparallel nonperpendicular angle to the side edges thereof, the production tool for the making of the abrasive article is arranged vis-a-vis the backing sheet such that the patterned array of cavities are so configured so as to directly form abrasive ridges from an abrasive slurry which have a directionality which is neither parallel nor perpendicular to the eventual machine direction axis of the abrasive article. For instance, the cavities provided in a production tool for forming the abrasive ridges can be disposed during a manufacturing scheme, such as schematized in FIGS. 4 and 5 and described hereinabove, all at a nonzero nonperpendicular angle to the machine direction axis of the backing sheet of the abrasive article. Thus, the resulting abrasive sheet article has ridges presenting the desired directionality. Optionally, if an endless belt configuration would be convenient for the desired application, this abrasive sheet article, which already has the directionality or angled ridges imbued therein, can be formed into a continuous structure by bringing the two free ends of the backing sheet into juxtaposed position to form a juncture line, and adhesively securing the two free ends together at the juncture line to form a continuous abrasive belt article. This directionality in the ridges is retained when the abrasive article is converted to the final product, either a sheet, tape, or endless belt.

In the second method for making the nonparallel nonperpendicular ridges in the abrasive article of the present invention, the array of cavities in the production tool is arranged parallel to the side edges of the backing, and thus, the array of cured composites or ridges formed thereby, such as by a process of the types described in connection with FIGS. 4 and 5 herein, are initially arranged parallel to initial side edges of the backing of a preform abrasive sheet article. However, by the time the abrasive article is converted into the final endless abrasive article, the angled directionality is achieved, such as by the technique described below. In most instances, the abrasive article will be made in a jumbo form. For sheets and most tape and belt forms, the width of the jumbo form is greater than the desired width of the final abrasive article. Thus, for such forms, the abrasive article is slit or die cut into the desired dimensions. During slitting or die cutting, the jumbo is converted such that the angle of the array of composites is left at an angle that is nonparallel and non perpendicular to the resulting coated abrasive side edges, i.e., the jumbo is converted at a specifed angle. The following techniques are suitable towards achieving this end.

A preferred technique for forming an endless belt form of the abrasive article of the present invention from a jumbo form having abrasive ridges extending parallel to the machine direction axis and side edges, as a preform, involves forming a splice where the composite arrays are misaligned with lateral displacement at the splice area by appropriately bringing the two free ends together to form the juncture line of an abrasive sheet article preform, and then the endpoint of one abrasive ridge is moved transversely along the width of the jumbo preform so as to align with an endpoint of a different ridge, and then adhesively securing the different endpoints together, as so aligned, by any convenient securing or splicing means, such as by adhesive splice means known in the field, to form an endless spliced belt article. Then, optionally, this first endless belt article can have the nonaligned side edge portions on each side of the belt trimmed away by cutting two separate slits each cut in a direction parallel to the machine direction through the entire circumference of the first endless belt at two locations located completely within the first belt side edges to form a trimmed endless abrasive belt having two parallel abrasive belt side edges, wherein all of the ridges still trace a line extending at a nonzero nonperpendicular angle to the machine direction axis.

As another technique for making an endless belt article according to the present invention from a jumbo sheet having ridges extending parallel to the side edges, a splice is made in the jumbo form such that the arrays and respective two endpoints of each ridge are arranged as aligned at the juncture line of the splice area to form an endless belt preform. However, after the splice is made, the endless belt preform is slit or cut whereby two separate slits are each cut in at a nonzero nonperpendicular angle to the machine direction axis through the entire circumference of the endless belt preform at two locations located completely within the side edges of the endless belt preform. The side trimmings can be discarded and the cut endless belt will have ridges which all extend at a nonzero nonperpendicular angle to the machine axis direction.

Therefore, this technique also results in an abrasive belt structure having a helical or cork-screw pattern of the arrays that is maintained when the full width belt is slit or cut at a non-angle.

Workpiece

The workpiece that can be refined by the abrsive article of the present invention can be many types of material such as metal, metal alloys, exotic metal alloys, ceramics, glass, wood, wood like materials, composites, painted surface, plastics, reinforced plastic, stones, and combinations thereof. The workpiece may be flat or may have a shape or contour associated with it. Examples of workpieces include glass eye glasses, plastic eye glasses, plastic lenses, glass television screens, metal automotive components, plastic components, particle board, cam shafts, crank shafts, furniture, turbine blades, painted automotive components, magnetic media, and the like.

Depending upon the application, the force at the abrading interface can range from about 0.1 kg to over 1000 kg. Generally this range is between 1 kg to 500 kg of force at the abrading interface. Also depending upon the application, there may be a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like. The abrasive article may oscillate at the abrading interface during use. In some instances, this oscillation may result in a finer surface on the workpiece being abraded.

The abrasive article of the invention can be used by hand or used in combination with a machine. At least one or both of the abrasive article and the workpiece is moved relative to the other. The abrasive article can be converted into a belt, tape rolls, disc, sheet, and the like, but an endless belt is preferred. For belt applications, the two free ends of an abrasive sheet are joined together and a splice is formed. Generally the endless abrasive belt traverses over at least one idler roll and a platen or contact wheel. The hardness of the platen or contact wheel is adjusted to obtain the desired rate of cut and workpiece surface finish. The abrasive belt speed ranges generally from about 2.5 to 80 meters per second, and usually between 8 to 50 meters per second. Again this belt speed depends upon the desired cut rate and surface finish. The belt dimensions can range from about 5 mm to 1,000 mm wide and from about 50 mm to 10,000 mm long. Abrasive tapes are continuous lengths of the abrasive article. They can range in width from about 1 mm to 1,000 mm, generally between 5 mm to 250 mm. The abrasive tapes are usually unwound, traverse over a support pad that forces the tape against the workpiece and then rewound. The abrasive tapes can be continuously feed through the abrading interface and can be indexed.

The following non-limiting examples will further illustrate the invention. All parts, percentages, ratios, etc., in the examples are by weight unless otherwise indicated.

EXAMPLES

Test Procedure 1

Test Procedure 1 was designed to test the cut of the coated abrasive articles manufactured as described in the examples hereinbelow. The abrasive article was converted into a 203 cm by 6.3 cm endless belt and was installed on a Thompson grinding machine. The effective cutting area of the abrasive belt was 203 cm by 2.54 cm. The workpiece was 1018 mild steel, 2.54 cm width by 17.78 cm length by 10.2 cm height and was mounted on a reciprocating table. Abrading was conducted along the 2.54 by 17.78 cm face. The abrading process used was conventional surface grinding wherein the workpiece was reciprocated beneath the rotating abrasive belt with incremental downfeed between each pass. The abrading conditions were: approximately 2.54 micrometers downfeed, 50.8 millimeters/second throughfeed (table speed), and a belt speed of about 28.4 surface meters/second with a water flood (with 1% rust inhibitor). Each belt was used until it was worn to the backing.

Experimental Procedure

For the Examples, the following were mixed to form an abrasive slurry, 29.5 parts of 50:50:1 triacrylate of tris(hydroxy ethyl)isocyanurate: trimethylol propane triacrylate: 2-benzyl-2-N,N-dimethylamino-1-(4-morpholinophenyl)-1-butanone commercially available from Ciba Geigy Corp. under the trade designation "Irgacure 369"; 69 parts white aluminum oxide (40 micrometer average particle size); 0.5 parts silane coupling agent, and 1 part amorphous silica filler commercially available from DeGussa under the trade designation "OX-50".

The abrasive slurry was coated via a fluid bearing vacuum die onto a nickel production tool having a pyramidal type pattern such that the abrasive slurry filled recesses in the tool. The pyramidal pattern was such that their bases were butted up against one another. The height of the pyramids was about 533 micrometers. The filled tool was brought into contact with a 130 micrometer thick polyester theraphthalate (PET) film with a 20 micrometer thick coating of ethylene acrylic acid primer on the front surface. The article was cured by passing the tool together with the backing and binder precursor under two 300 Watt Hg bulbs available form Aetek. The radiation passed through the PET film backing. The speed was about 3 meters per minute and four passes. This light resulted in the abrasive slurry being transformed into an abrasive composite and the abrasive composite being adhered to the polyester film substrate. Next, the polyester film/abrasive composite construction was separated from the production tool at a nip roll to form an abrasive article. This was a continuously run process.

Example 1

Example 1 was run by taking an abrasive article made according to the above Experimental Procedure and forming an endless belt therefrom. To accomplish this, the abrasive article was cut to 203 cm and the two free ends were manipulated into such a juxtaposed alignment and secured to impart a certain directionality in the array of composites, i.e., the angle of the ridges to the side edges of the backing was made about 1 degree from parallel to the side edges of the backing; the endpoint of each ridge was offset about 32 rows of ridges in the transverse direction of the belt, and then two free ends of the article were adhesively spliced together to form an endless belt article.

Comparative Example A

Comparative Example A was produced by taking an abrasive article made according to the Experimental Procedure and forming an endless belt therefrom. The abrasive article was cut to 203 cm and the two ends were aligned so that the directionality of the array was parallel to the side edges of the backing, i.e., the ridges were arranged parallel to the central axis and side edges of the belt, and the free ends of the article were adhesively spliced with the ridges maintained in the parallel orientation to the side edges.

Example 2

Example 2 was run in the same manner as Example 1 except that the offset was about 635 rows of ridges to provide an angle of the ridges to the side edges of the backing of about 14 degrees.

Table 1 shows the results from Examples 1, 2, and Comparative Example A when tested according to Test Procedure 1.

TABLE 1

| | total cut |
|---|---|
| Comparative Example A | 20.7 g |
| Example 1 | 30.7 g |
| Example 2 | 35.3 g |

The results in Table 1 show that the total cut achieved by the abrasive articles of Examples 1 and 2 having abrasive ridges oriented at a nonparallel nonperpendicular angle to the side edges of the abrasive article and representing the present invention were significantly greater than that observed for the abrasive article of Comparative Example A wherein the abrasive ridges were all aligned parallel to the side edges of the abrasive article.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising: a surface having a machine direction axis and opposite side edges, each side edge being parallel to said machine direction axis; and a plurality of parallel rows of precisely shaped abrasive composites in fixed position on said surface, each precisely shaped abrasive composite comprising abrasive particles and binder and having a base attached to said surface, a height and a distal end spaced by said height from said surface, the bases of said precisely shaped abrasive composites in the same row being aligned at an angle with respect to one of said side edges which is neither 0° nor 90°.

2. The abrasive article, according to claim 1, wherein each of said precisely shaped abrasive composite has a cross sectional area measured along its height which increases from its distal end to its base.

3. The abrasive article of claim 1 wherein said precisely shaped abrasive composites are elongate abrasive ridges.

4. The abrasive article of claim 1 wherein said angle varies from about 1° to 45°.

5. The abrasive article of claim 1 wherein said angle varies from about 1° to about 14°.

6. The abrasive article of claim wherein said surface is the surface of a backing sheet.

7. The abrasive article of claim 6 wherein said backing sheet is a loop.

8. The abrasive article of claim 4 wherein said backing sheet is elongate along said machine direction and has opposite mating ends which are secured together to form said loop.

9. The abrasive article of claim 1 wherein said abrasive composites are uniformly spaced on said surface.

10. The abrasive article of claim 1 wherein said rows of abrasive composites are uniformly spaced on said surface.

11. The abrasive article of claim 1 wherein said abrasive composites are all of the same height.

12. A method of making an abrasive article, said method comprising: applying to a surface having a machine direction axis, opposite ends and opposite side edges, each side edge being parallel to said machine direction axis, a plurality of parallel rows of precisely shaped abrasive composites in fixed position on said surface, each precisely shaped abrasive composite comprising abrasive particles and binder and having a base attached to said surface, a height and a distal end spaced by said height from said surface, the bases of said precisely shaped abrasive composites in the same row being aligned at an angle with respect to one of said side edges which is neither 0° nor 90°.

13. A method of making an abrasive article, said method comprising:

(a) providing an abrasive article having a backing which includes a surface having opposite initial side edges and a plurality of parallel rows of precisely shaped abrasive composites in fixed position on said surface, each precisely shaped abrasive composite comprising abrasive particles and binder and having a base attached to said surface, a height and a distal end spaced by said height from said surface, the bases of said precisely shaped abrasive composites in the same row being aligned at an angle with respect to one of said initial side edges which is either 0° or 90°, and (b) slitting said abrasive article within said initial edges to provide parallel resulting edges so that said rows are at an angle with respect to said parallel resulting side edges which angle is neither 0° nor 90°.

14. A method of making an abrasive belt, said method comprising:

(a) providing a backing sheet having a surface, two opposite complementary ends, and opposite side edges;

(b) providing, on the backing sheet, a plurality of parallel elongate ridges in fixed position on the surface, each ridge comprising at least one abrasive composite and having a base extending in the same direction as the side edges and a distal end which is spaced from the surface;

(c) joining together said two opposite complementary ends of said backing sheet at a juncture line to provide a closed loop having abutted ends positioned in a lateral displaced relationship so that ridges adjacent each of the ends spaced the same distance from their respective side edges are not aligned with one another but so as to align with other adjacent ridges at abutted ends; and (d) securing the joined opposite complementary ends at said juncture line to provide an endless abrasive belt.

15. The method of claim 14 including the further step of slitting the side edges of the closed loop to provide a belt having new side edges which define a substantially uniform belt width therebetween providing an abrasive belt with a machine direction axis which is aligned in the same direction as the new side edges and abrasive ridges on said backing which are aligned neither normal nor parallel with the new side edges.

* * * * *

UNITED STATES PATENT AND TRADEMARK OFFICE

CERTIFICATE OF CORRECTION

PATENT NO. : 5,489,235
DATED : February 6, 1996
INVENTOR(S) : John J. Gagliardi and Roger C. Lokken It is certified that error appears in the above-identified patent and that said Letters Patent is hereby corrected as shown below:

Column 1,
Line 25, "Pieper al." should be -- Pieper et al. --.

Column 2,
Line 39, "and thensubjected to" should be -- and then subjected to --.

Column 11,
Line 59, "Method for Making" should be -- Methods for Making --.

Column 13,
Line 43, "(120 to 240 watt/era)" should be -- (120 to 240 watt/cm) --.

Column 15,
Line 22, "nonzero, (nonparallel)" should be -- nonzero (nonparallel) --.

Column 16,
Line 10, "parallel to initial" should be -- parellel to the --.

Column 19,
Line 51, “article of claim wherein said” should be -- article of claim 1 wherein said --.
Line 55, "of claim 4 wherein" should be -- of claim 7 wherein --.

Signed and Sealed this

Sixteenth Day of July, 2002

*Attest:*

*Attesting Officer*

JAMES E. ROGAN
*Director of the United States Patent and Trademark Office*